US005662421A

United States Patent [19]

Hagiwara et al.

[11] Patent Number: 5,662,421

[45] Date of Patent: Sep. 2, 1997

[54] PRINT SPEED CONTROLLED DOT LINE PRINTER DEPENDING ON PRINT DENSITY

[75] Inventors: Kiyohito Hagiwara; Yoshikane Matsumoto; Shingo Nakahara; Masami Iwama, all of Hitachinaka, Japan

[73] Assignee: Hitachi Koki Company, Ltd., Tokyo, Japan

[21] Appl. No.: 426,865

[22] Filed: Apr. 24, 1995

[30] Foreign Application Priority Data

Apr. 22, 1994 [JP] Japan ..... 6-084822

[51] Int. Cl.[6] ..... B41J 29/38

[52] U.S. Cl. ..... 400/124.13; 400/54; 400/323

[58] Field of Search ..... 400/124.03, 124.13, 400/279, 323, 54, 74

[56] References Cited

U.S. PATENT DOCUMENTS 4,653,940 3/1987 Katsukawa ..... 400/124.03
5,064,302 11/1991 Tanuma ..... 400/124.03

FOREIGN PATENT DOCUMENTS 262776 9/1994 Japan ..... 400/124.03

*Primary Examiner*—Edgar S. Burr
*Assistant Examiner*—Steven S. Kelley
*Attorney, Agent, or Firm*—Whitham, Curtis, Whitham & McGinn

[57] ABSTRACT

To prevent undue elevation of temperature in a hammer assembly but to maintain the maximum printing speed, when a scheduled number of drivings at which print hammers are to be driven during one scan of a manner bank which follows the currently performing scan, exceeds a first reference number, one dot line printing is completed with a plurality of scans of the hammer bank so that dot line print density in each scan of the hammer bank does not exceed, for example, 35%. If, however, high density printing exceeding 25% continues for an extended period of time more than one scan time, the printing operation is temporarily halted.

18 Claims, 3 Drawing Sheets

PRINT SPEED CONTROLLED DOT LINE PRINTER DEPENDING ON PRINT DENSITY

BACKGROUND OF THE INVENTION

1. Field of the Invention

The present invention relates to a dot line printer having a plurality of print hammers which are selectively fired to make impressions of dots. More particularly, the invention relates to a method and apparatus for controlling a print speed depending on a print density to prevent overheating of the manner assembly.

2. Description of the Prior Art

FIG. 1 schematically shows a dot line printer. Although not illustrated in FIG. 1, a plurality of print hammers are mounted on a hammer bank 3. The hammer bank 3 is driven by a shuttle motor 1 through a cam 2 and is reciprocally moved between two extremes to traverse a print paper. With a single rotation of the motor 1, the hammer bank 3 makes one way movement (one scan) and reverses at one of the two extremes. A rotary encoder 4 formed with a predetermined number of angularly spaced slits is mounted on a cam shaft. A photocoupler 5 consisting of a light emitting diode and a photodiode is disposed in association with the rotary encoder 4 for detecting an angular movement of the rotary encoder 4. A platen 6 is rotatably supported on a printer frame (not shown) for supporting the print paper thereon. A pair of pin tractors 9 are disposed in side marginal portions of the print paper, which upon engaging perforations formed on two sides of the print paper, move the print paper while cooperating with the platen 6. The print paper 8 is fed intermittently in a direction perpendicular to the direction in which the hammer bank 3 reciprocates. Both the platen 6 and the pin tractors 9 are driven by a paper feed motor 8.

FIG. 2 shows a print hammer and its drive unit. The print hammer 11 is in the form of an elongated leaf spring having an upper end to which a dot pin 12 is attached and a lower end fixedly secured through a front yoke 15 to a mounting plate 14 by a screw 16. A plunger 13 is also attached to the upper portion of the leaf spring. In association with each print hammer 11, there are provided a permanent magnet 17, a yoke 18, and an electromagnetic coil 19 wound around the yoke 18. The magnet 17 and the yoke 18 are elongated plate like members both extending in the direction parallel to the print line or perpendicular to the sheet of drawing so as to be commonly used by the plurality of print hammers 11. The upper portion of the hammer 11 is magnetically attracted to the pole of the yoke 18 and is released therefrom in response to print data causing to energize the coil 19. The dot pin 12 thus strikes the print paper through the ink ribbon 7, thereby making an impression of a dot on the paper. It is to be noted that the print hammer driver unit shown in FIG. 2 is shown by way of an example. Other types of driver units are also available.

The hammer assembly of the dot line printer generates heat with energization of the coil 19. To prevent the overheat of the hammer assembly, printing operation has been controlled with a print control circuit shown in FIG. 3. The circuit includes a counter 20 supplied with print data from a print data transmission circuit 10. The counter 20 counts a scheduled number of drivings at which the hammers 11 are to be driven during a forthcoming single scan of the hammer bank 3 wherein the hammer bank 3 moves from the first extreme to the second extreme or vice versa. The scheduled number of drivings is equal to a number of dots to be printed in one dot line.

A comparator 30 is connected to the output of the counter 20. The comparator 30 has a first input supplied with the output of the counter 20, i.e., the scheduled number of drivings, and a second input supplied with a reference number from a data latch circuit 40. The comparator 30 performs two stage comparisons wherein the comparator 30 first compares the scheduled number of drivings with the reference number, and thereafter the scheduled number of drivings with another reference number twice as large as the reference number latched in the data latch circuit 40. The comparator 30 outputs a print mode change instruction which indicates one of three alternatives, one being a status wherein the scheduled number of drivings is smaller than the reference number, second being a status wherein the scheduled number of drivings is larger than the reference number but smaller than twice the reference number, and third being a status wherein the scheduled number of drivings is larger than twice the reference number. A control unit 50 is connected to the output of the comparator 30 and controls a print hammer drive circuit 70 in response to the print data supplied from the print data transmission circuit 10 and the print mode change instruction from the comparator 30. The print hammer drive circuit 70 drives the print hammers in a divided mode when the print mode change instruction indicates that the scheduled number of drivings is greater than the reference number. When the print mode change instruction indicates the second alternative, printing of dots in one dot line is performed with two scans of the hammer bank 3. When the print mode change instruction indicates the third alternative, printing of dots in one dot line is performed with four scans of the hammer bank 3. In the divided mode, one dot line is not completely printed until the hammer bank 3 moves with forward and backward movements for several times. By printing in the divided mode, the number of drivings at which the hammers are driven in one scan of the hammer bank 3 can be reduced to less than the reference number set in the circuit 40.

The reference number is set to indicate an upper limit of an allowable number of dots that can be printed in one dot line. The circuit shown in FIG. 3 controls a dot line print density with one scan of the hammer bank 3 so as not to exceed a value obtained by dividing the reference number set in the circuit 40 with the maximum number of dots that can be printed in one dot line. More specifically, if M dots are printable at maximum in one dot line, the printer is allowed to perform normal printing when one line print density is less than m/M wherein m indicates the scheduled number of hammer drivings in one dot line. As shown in the timing chart of FIG. 4, the conventional printer sets m/M to 25%. When m/M exceeds 25% but below 50%, the control unit 50 controls the print hammer drive circuit 70 to perform printing in a two-divided mode wherein one dot line printing is accomplished with two scans of the hammer bank 3. When m/M exceeds 50%, the control unit 50 controls the print hammer drive circuit 70 to perform printing a four-divided mode wherein one dot line printing is accomplished with four scans of the hammer bank 3. Therefore, in the two- or four-divided modes, a ratio of the dot number printed during one scan of the hammer bank 3 to the maximum number M does not exceed 25%.

The conventional print control circuit shown in FIG. 3 is disadvantage in that the print mode frequently shifts to the two- or four-divided mode even if high density printing does not last for a long time and therefore the overheating problem of the print hammer assembly does not occur. The frequent shifts to the divided mode delays the overall printing speed. One possible solution to this problem is to increase the critical values for shifting to the divided modes. However, if this is done, the cooling efficiency of a hammer cooling mechanism and heat radiation of the print hammer driving circuit 70 must be improved. Also electric power consumption increases attendant to the increase of the critical values.

SUMMARY OF THE INVENTION

In view of the foregoing, it is an object of the present invention to provide an improved print control circuit for a dot line printer capable of preventing undue elevation of temperature in a hammer assembly, yet maintaining the printing speed to a possible maximum.

It is another object of the present invention to provide a print control circuit wherein electric power consumption does not increase.

To achieve the above and other objects, there is provided, in accordance with one aspect of the invention, a dot line printer having a hammer bank and a plurality of print hammers mounted thereon. Each print hammer has a dot pin for printing a dot. The print hammers are selectively driven by a first drive means in accordance with print data. The hammer bank is reciprocally moved by the second drive means between first and second extremes. The hammer bank moving from the first extreme to the second extreme or vice versa is referred to as one scan. The printer has first counting means for counting, based on the print data, a scheduled number of drivings at which the plurality of print hammers are to be driven during a forthcoming single scan. The scheduled number of drivings is equal to a number of dots to be printed in one dot line. First comparison means is provided for comparing the scheduled number of drivings counted by the first counting means with a first reference number, and a print mode change instruction is outputted when the scheduled number of drivings is greater than the first reference number. Control means controls the first drive means to complete printing of dots in one dot line with a plurality of scans of the hammer bank in response to the print mode change instruction.

Specifically, the control means controls said first drive means to complete printing of dots in one dot line with two scans of the hammer bank when the print mode change instruction indicates that the scheduled number of drivings exceeds a first critical value, and the control means controls the first drive means to complete printing of dots in one dot line with four scans of the hammer bank when the print mode change instruction indicates that the schedules number of drivings exceeds a second critical value larger than the first critical value. For example, the first critical value is determined to correspond to 35% print density and the second critical value to 70% print density. The first and second critical values are set to be larger than conventionally adopted values.

The printer further includes time measuring means for measuring a predetermined time duration. Second counting means is provided for counting an actual number of drivings at which the plurality of print hammers are actually driven from a start of the predetermined time duration. Second comparison means compares the actual number of drivings counted by the second counting means with a second reference number and outputs a print halt instruction when the actual number of drivings is greater than the second reference number. The control means controls the first drive means to halt printing of the dots until the predetermined time duration expires in response to the print halt signal.

A ratio of the first reference number to a maximum number of dots that can be printed in one dot line is set larger than a ratio of the second reference number to a maximum number of dots that can be printed during the predetermined time duration, and the predetermined time duration measured by the time measuring means is set longer than a time duration of one scan of the hammer bank.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 1:
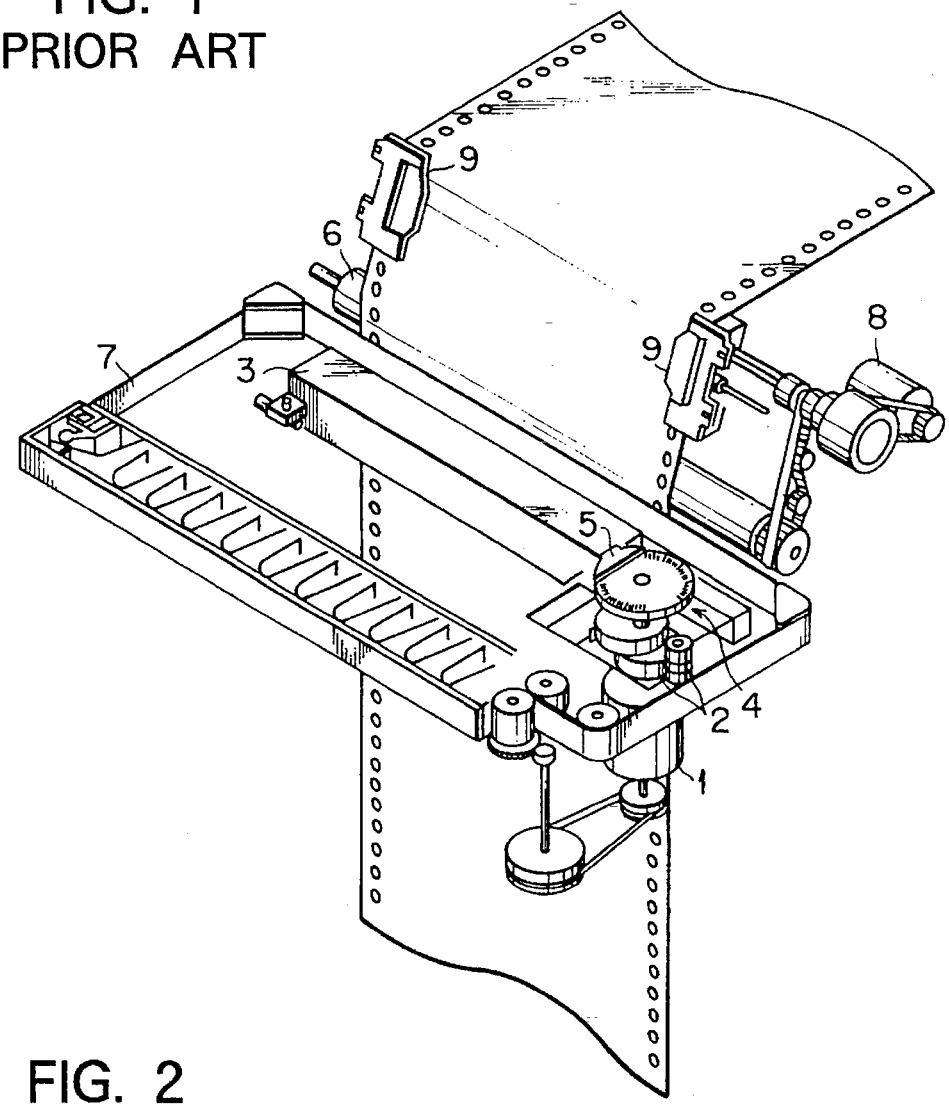
FIG. 1 PRIOR ART
FIG. 1 is a schematic diagram showing an example of a dot line printer.
Figure 2:
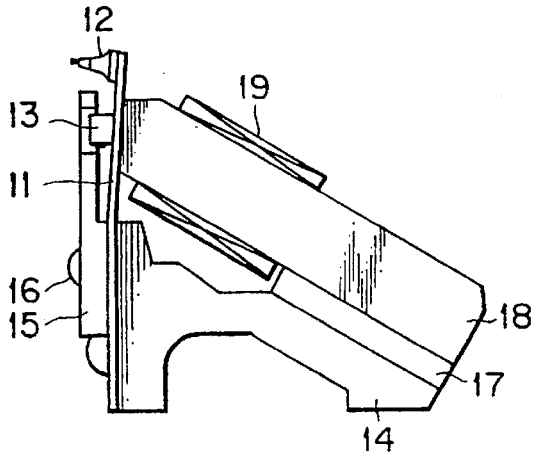
FIG. 2 PRIOR ART
FIG. 2 is a side elevational view showing a print hammer assembly.

A preferred embodiment of the present invention will now be described with reference to the accompanying drawings wherein like reference numerals refer to like blocks throughout.

Figure 3:
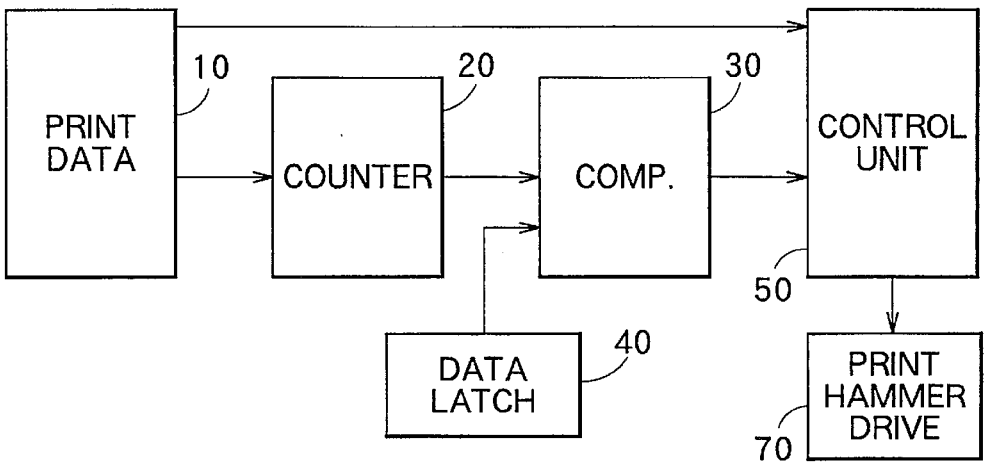
FIG. 3 PRIOR ART
FIG. 3 is a block diagram showing a conventional print control circuit.
Figure 4:
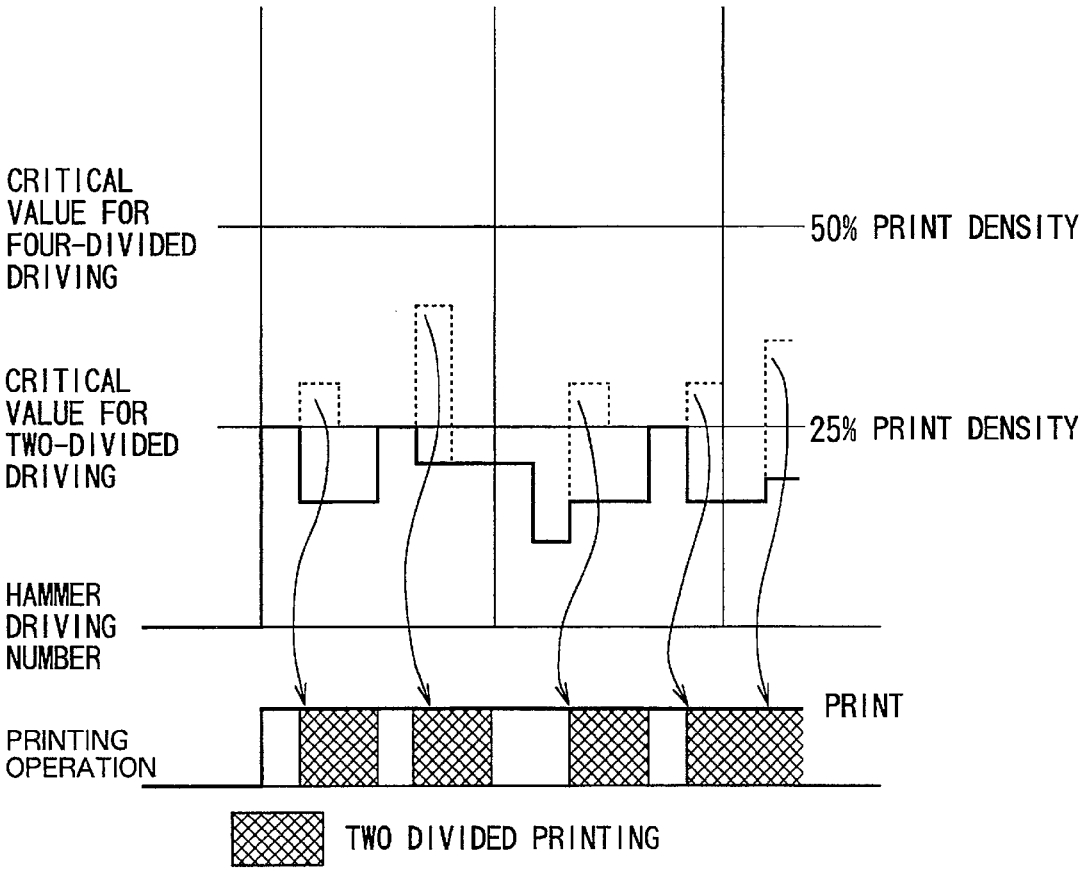
FIG. 4 PRIOR ART
FIG. 4 is a timing chart for describing the operation of the circuit shown in FIG. 3.
Figure 5:
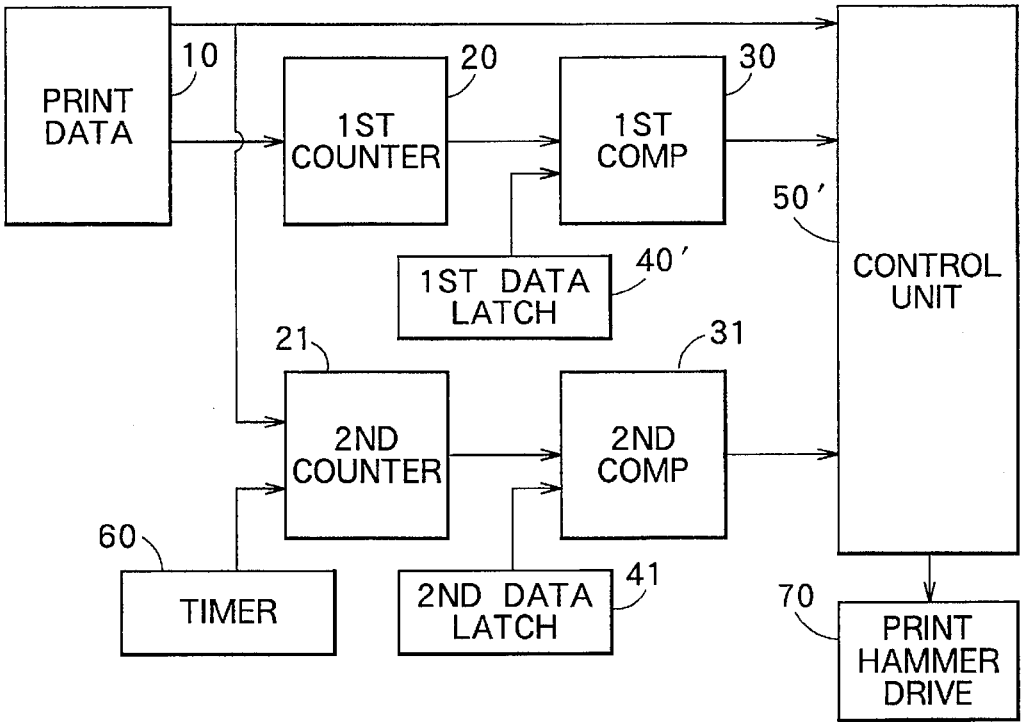
FIG. 5 is a block diagram showing a print control circuit according to an embodiment of the present invention.

A print control circuit according to the embodiment of this invention is shown in block form in FIG. 5 wherein a print data transmission circuit 10, a first counter 20, a first comparator 30, and a print hammer drive circuit 70 are identical in construction and operation to the components designated by the same reference numerals in FIG. 3. A first data latch circuit 40' is identical in construction to the data latch circuit 40 shown in FIG. 3, however, the reference number latched in the first data latch circuit 40' is larger than that latched in the data latch circuit 40. Typically, the conventional printer is not switched to the divided print mode in which one dot line printing is accomplished with a plurality of scans of the hammer bank 3, unless the print density in one dot line exceeds 25%. In this embodiment, the reference number to be latched in the first data latch circuit 40' is determined so that the normal printing continues if the print density in one dot line does not exceed 35%. The dot line print density of 35% is likely to occur when complicated characters, such as Chinese characters, are consecutively printed. Heat generation resulting from 35% print density is not a serious problem as far as the 35% density dot line printing does not continue for more than one scan of the manner bank 3. To set the critical value for shifting to the divided mode to 35%, the reference number to be latched in the first data latch circuit 40' is determined so as to be 35% of the total number (M) of printable dots in one dot line.

The print control circuit of this embodiment further includes a second counter 21 having a first input supplied with the print data from the print data transmission circuit 10 and a second input connected to a timer 60. The timer 60 measures a predetermined time duration T. The second counter 21 counts, based on the print data, an actual number of drivings at which the hammers are actually driven from the start of the predetermined time duration T, the outputs a counted value. The counted value increments each time any one of the hammers is driven. A second comparator 31 is connected to the output of the second counter 21. The second comparator 31 is also supplied with a second reference number from a second data latch circuit 41. The second reference number to be latched in the second data latch circuit 41 is determined to be 25% of the total number of printable dots during the predetermined time duration T. The outputs from the first and second comparators 30 and 31 are connected to a control unit 50'. The control unit 50' controls the print hammer drive circuit 70 to operate in the divided print mode in accordance wit the output from the first comparator 30 as is done in the conventional control unit 50, and further controls the print hammer drive circuit 70 to halt printing in accordance with the output from the second comparator 30.

Figure 6:
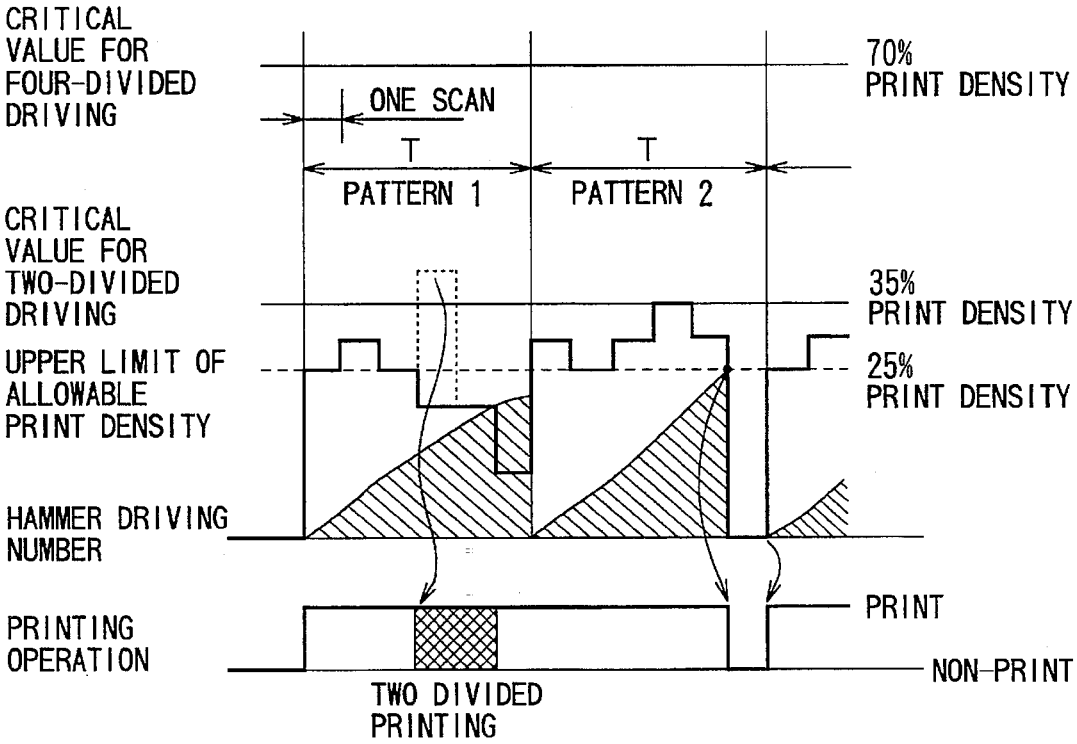
FIG. 6 is a timing chart for describing the operation of the circuit shown in FIG. 5.

Operation of the print control circuit shown in FIG. 5 will be described while referring to the timing chart shown in FIG. 6.

The first counter 20 receives the print data for a dot line to be printed following the currently printing dot line, and counts the scheduled number of drivings at which the print hammers are to be driven. The counted number is compared with the first reference number and also with a number twice as large as the first reference number in the first comparator 30. The comparator 30 outputs a print mode change instruction which indicates one of three alternatives, one being a status wherein the scheduled number of drivings is smaller than the first reference number, second being a status wherein the scheduled number of drivings is larger than the first reference number but smaller than twice the first reference number, and third being a status wherein the scheduled number of drivings is larger than twice the first reference number. When the print mode change instruction indicates the first alternative, the control unit 50' controls the print hammer drive circuit 70 to perform normal printing in which one dot line printing is performed with a single scan of the hammer bank 3. When the print mode change instruction indicates the second alternative, that is, when the counted value in the first counter 20 corresponds to a dot lien print density in a range from 35% to 70%, the control units 50' controls the print hammer drive circuit 70 to operate in a two-divided print mode in which one dot line printing is accomplished with two scans of the hammer bank 3. When the print mode change instruction indicates the third alternative, that is, when the counted value in the first counter 20 corresponds to a dot line print density above 70%, the control units 50' controls the print hammer drive circuit 70 to operate in a four-divided print mode in which one dot line printing is accomplished with four scans of the hammer bank 3. In this manner, in the divided print mode, the number of scans to be performed by the hammer bank 3 to complete one dot line printing is determined depending on the number of hammer drivings counted by the first counter 20. The number of dots printed during each scan of the hammer bank 3 i the divided print mode does not exceed 35% of the print density. In the pattern 1 of the FIG. 6 timing chart, the number of hammer drivings to be performed for a particular dot line exceeds 35% dot line print density but below 70% dot line print density as indicated by a dotted line. Therefore, the hammer bank 3 performs two scans to complete the printing of this particular dot line.

The timer 60 measures a predetermined time duration T. The second counter 21 monitors the print data currently supplied to the hammer drive circuit and counts an actual number of hammer drivings from the start of the predetermined time duration T. When the counted number exceeds the second reference number before expiration of the time duration T, the second comparator 31 outputs a print halt instruction to the control unit 50' so that printing is halted thereafter until the predetermined time duration T is expired, as shown in pattern 2 of FIG. 6 timing chart. Printing is halted because the dot printings performed during a certain period of time has reached an upper limit of allowable dot print density (25%). If the number of dots printed in each of successive dot lines printed during said certain period of time does not exceed the first reference number, that is, the dot line print density is less than 35%, then the predetermined time duration is set longer than a time duration at which the hammer bank 3 makes one scan movement.

As described, according to the present invention, printing for one dot line is continued even if the dot number printed during one scan of the hammer bank 3 slightly exceeds an allowable level. However, the printing operation is halted when the dot number printed during an extended period of time has reached to the upper limit of the allowable level. Therefore, the print speed reduction resulting from frequently occurring print mode shift to the divided mode can be avoided and temperature elevation caused by high density printing can be effectively prevented.

What is claimed is:

1. A printer comprising:

a hammer bank reciprocally movable between first and second extremes;

a plurality of print hammers mounted on said hammer bank, each print hammer having a dot pin for printing a dot;

first drive means for selectively driving said plurality of print hammers in accordance with print data;

second drive means for reciprocally moving said hammer bank;

first counting means for counting, based on the print data, a scheduled number of drivings at which said plurality of print hammers are to be driven during a forthcoming single scan wherein said hammer bank moves from the first extreme to the second extreme of vice versa, the scheduled number of drivings corresponding to a number of dots to be printed in one scan;

first comparison means for comparing the scheduled number of drivings counted by said first counting means with a first reference number and for outputting a print mode change instruction when the scheduled number of drivings is greater than the first reference number;

time measuring means for measuring a predetermined time duration;

second counting means for counting an actual number of drivings at which said plurality of print hammers are actually driven from a start of the predetermined time duration;

second comparison means for comparing the actual number of drivings counted by said second counting means with a second reference number and for outputting a print halt instruction when the actual number of drivings is greater than the second reference number; and control means for controlling said first drive means to complete printing of dots in the scheduled number of drivings with a plurality of scans of said hammer bank in response to the print mode change instruction, and to halt printing of the dots until the predetermined time duration expires in response to the print halt signal, wherein a ratio of the first reference number to a maximum number of dots that can be printed in one scan is larger than a ratio of the second reference number to a maximum number of dots that can be printed during the predetermined time duration.

2. A printer according to claim 1, wherein the predetermined time duration measured by said time measuring means is longer than a time duration of one scan of said hammer bank.

3. The printer as in claim 1, wherein said print mode change comprises reducing a printing speed.

4. The printer as in claim 3, wherein said printing speed is reduced by one of 50% and 25% by said print mode change.

5. The printer as in claim 1, wherein said first reference number comprises 35% of a total number of printable dots in one scan.

6. The printer as in claim 1, wherein said second reference number comprises a value based on a speed of said printer and said predetermined time duration, such that no more than 25% of a total number of printable dots are printed per scan.

7. The printer as in claim 6, wherein said predetermined time period exceeds a period of time required to print one scan.

8. A printer comprising:

a hammer bank reciprocally movable between first and second extremes;

a plurality of print hammers mounted on said hammer bank, each print hammer having a dot pin for printing a dot;

first drive means for selectively driving said plurality of print hammers in accordance with print data;

second drive means for reciprocally moving said hammer bank;

first counting means for counting, based on the print data, a scheduled number of drivings at which said plurality of print hammers are to be driven during a forthcoming single scan wherein said hammer bank moves from the first extreme to the second extreme or vice versa, the scheduled number of drivings corresponding to a number of dots to be printed in one scan;

first comparison means for comparing the scheduled number of drivings counted by said first counting means with a first reference number and for outputting a print mode change instruction when the scheduled number of drivings is greater than the first reference number;

time measuring means for measuring a predetermined time duration;

second counting means for counting an actual number of drivings at which said plurality of print hammers are actually driven from a start of the predetermined time duration;

second comparison means for comparing the actual number of drivings counted by said second counting means with a second reference number and for outputting a print halt instruction when the actual number of drivings is greater than the second reference number; and control means for controlling said first drive means to complete printing of dots in the scheduled number of drivings with a plurality of scans of said hammer bank in response to the print mode change instruction, and to halt printing of the dots until the predetermined time duration expires in response to the print halt signal, wherein said first comparison means includes a first data latch circuit latching the first reference number, and said second comparison means includes a second data latch circuit latching the second reference number, wherein a ratio of the first reference number to a maximum number of dots that can be printed in one scan is set larger than a ratio of the second reference number to a maximum number of dots that can be printed during the predetermined time duration.

9. A printer according to claim 8, wherein said control means controls said first drive means to complete printing of dots in one scan with two scans of said hammer bank when the print mode change instruction indicates that the scheduled number of drivings exceeds a first critical value.

10. A printer according to claim 9, wherein said control means controls said first drive means to complete printing of dots in one scan with four scans of said hammer bank when the print mode change instruction indicates that the scheduled number of drivings exceeds a second critical value larger than the first critical value.

11. A method of controlling a printing operation comprising the steps of:

counting, based on print data, a scheduled number of drivings at which a plurality of print hammers are to be driven during a forthcoming single scan wherein a hammer bank moves from a first extreme to a second extreme or vice versa, the scheduled number of drivings corresponding to a number of dots to be printed in one scan;

comparing the scheduled number of drivings counted in said counting step with a first reference number and outputting a print mode change instruction when the scheduled number of drivings is greater than the first reference number;

measuring a predetermined time duration;

counting an actual number of drivings at which said plurality of print hammers are actually driven from a start of the predetermined time duration;

comparing the actual number of drivings counted in said actual number counting step with a second reference number and outputting a print halt instruction when the actual number of drivings is greater than the second reference number; and controlling a driving circuit for driving said plurality of print hammers to complete printing of dots in the scheduled number of drivings with a plurality of scan of said hammers bank in response to the print mode change instruction, and to halt printing of the dots until the predetermined time duration expires in response to the print halt signal, wherein a ratio of the first reference number to a maximum number of dots that can be printed in one scan is larger than a ratio of the second reference number to a maximum number of dots that can be printed during the predetermined time duration.

12. A method according to claim 11, wherein in said controlling step, printing of dots in one scan is completed with two scans of said hammer bank when the print mode change instruction indicates that the scheduled number of drivings exceeds a first critical value.

13. A method according to claim 12, wherein printing of dots in one scan is completed with four scans of said hammer bank when the print mode change instruction indicates that the scheduled number of drivings exceeds a second critical value larger than the first critical value.

14. A method according to claim 11, wherein the predetermined time duration is longer than a time duration of one scan of said hammer bank.

15. The method as in claim 11, wherein said print mode change instruction comprises a step of reducing a printing speed.

16. The method as in claim 11, wherein said first reference number comprises 35% of a total number of printable dots in one scan.

17. The method as in claim 11, wherein said second reference number comprises a value based on a speed of said printer and said predetermined time duration, such that no more than 25% of a total number of printable dots are printed per scan.

18. The method as in claim 17, wherein said predetermined time period exceeds a period of time required to print one scan.

* * * * *